United States Patent [19]

Wall et al.

[11] Patent Number: 5,048,153

[45] Date of Patent: Sep. 17, 1991

[54] SPA COVER LIFT MECHANISM

[75] Inventors: Michael R. Wall, Gig Harbor; James W. Campbell, Tacoma, both of Wash.

[73] Assignee: Starlite Leisure Products, Inc., Snohomish, Wash.

[21] Appl. No.: 480,093

[22] Filed: Feb. 14, 1990

[51] Int. Cl.[5] ..... E05D 11/00

[52] U.S. Cl. ..... 16/223; 16/1 C; 16/363

[58] Field of Search ..... 16/223, 1 C, 362, 363

[56] References Cited

U.S. PATENT DOCUMENTS

| | | | |
|---|---|---|---|
| 2,544,500 | 3/1951 | Jacobi | 16/1 C |
| 2,545,959 | 3/1951 | King . | |
| 2,582,635 | 1/1952 | Kipple | 16/1 C |
| 2,850,760 | 9/1958 | Vanderwalker . | |
| 3,490,642 | 1/1970 | Friedlander . | |
| 3,854,149 | 12/1974 | Mischke . | |
| 4,853,985 | 8/1989 | Perry . | |
| 4,899,420 | 2/1990 | Bye et al. | 16/1 C |

*Primary Examiner*—Robert L. Spruill
*Assistant Examiner*—Carmine Cuda
*Attorney, Agent, or Firm*—Christensen, O'Connor Johnson & Kindness

[57] ABSTRACT

A lift mechanism (15) for the cover (13) of a portable spa or hot tub (11) comprising a pair of compressible struts (21) and upper and lower hinge mechanisms (24 and 23) is disclosed. The preferred lower hinge mechanism (23) includes a torque tube (25) rotatably mounted through bushings (31) housed in plates (27). The plates (27) are located at a pair of adjacent lower corners of the spa or hot tub (11) and held down by the weight of the spa or hot tub (11). The struts (21) are attached to the ends of the torque tube (25). The other ends of the struts are attached to opposite sides of the spa cover by the upper hinge mechanisms (24), which preferably include brackets (33) that are fixed to the cover and pivot nuts (71) that rotatably attach the brackets (33) to the struts (21). When the cover is in its closed position, the struts (21) incline upwardly toward the center of the spa or hot tub (11). When the cover (13) is in its open position, the struts (21) lie substantially vertical. A stop mechanism formed by pairs of bolts (55 and 61) prevents the struts (21) from overrotating, i.e., rotating beyond a vertical position.

10 Claims, 3 Drawing Sheets

SPA COVER LIFT MECHANISM

TECHNICAL AREA

This invention relates to covers for spas or hot tubs and, more particularly, to mechanisms for lifting spa and hot tub covers.

BACKGROUND OF THE INVENTION

In recent years, the purchase and use of spas and hot tubs by homeowners has become widespread. Home spas and hot tubs are usually located outside of a house, frequently on a deck or in a back yard. In order to protect their water contents from airborne debris when not in use, spas and hot tubs are usually covered. Covers range from soft, single sheets of vinyl or other materials to hard covers formed of an insulating core material, such as expanded polystyrene enclosed by a protective material, such as vinyl. Hard insulated covers are preferred in cooler climates because they significantly limit heat loss and, as a result, reduce the cost of operating a spa or hot tub. One of the major disadvantages of hard spa and hot tub covers is their large and, thus, cumbersome nature. This disadvantage makes them somewhat difficult to remove even though they are relatively light in weight. The lightweight feature of hard spa and hot tub covers leads to another disadvantage. Specifically, unless held down in some manner, they can be easily shifted out of position and/or blown off by the wind.

The present invention is directed to a lift mechanism for a spa or hot tub cover that eases the removal and reinstallation thereof, while preventing the cover from being readily repositioned or blown off by the wind.

SUMMARY OF THE INVENTION

In accordance with this invention, a lift mechanism for the cover of a protable spa or hot tub is provided. The lift mechanism comprises a pair of compressible struts and hinge mechanisms located at both ends of the support struts. The compressible struts lie on opposite sides of the spa cover and angle downwardly from approximately the midpoint of the cover to a corner of the base of the spa. Hinge mechanisms located at the upper end of the compressible struts attach the struts to the spa cover. Hinge mechanisms located at the lower ends of the compressible struts attach the struts to a support located at the base of the spa. When the spa or hot tub cover is moved from its closed position atop the spa or hot tub to its open position, the cover is lifted by the upper ends of the struts. When this occurs, the cover rotates with respect to the struts, as the struts rotate with respect to the fixed support. Rotation ends when the cover and the struts are substantially coplanar and vertical. When the cover is closed, the compressible struts hold the cover in position.

In accordance with other aspects of this invention, the compressible struts include telescoping tubes and a coil spring positioned to elongate the telescoping tubes.

In accordance with further aspects of this invention, the fixed support comprises a pair of plates and lower hinge mechanisms that rotatably attach the compressible struts to the plates.

In accordance with still other aspects of this invention, the lower hinge mechanisms comprise a flange on each of the plates, bushings mounted in the flanges, and a torque tube mounted through the bushings. The lower ends of the compressible struts are attached to the ends of the torque tube.

In accordance with yet further aspects of this invention, the upper hinge mechanisms comprise brackets attached to the spa tub cover and rotation mechanisms for attaching the upper ends of the compressible struts to the brackets.

In accordance with yet still other aspects of this invention, the rotation mechanisms include pivot nuts affixed to the brackets and rotatably attached to the upper ends of the compressible struts.

In accordance with yet still further aspects of this invention, the compressible struts include cover tubes that enclose the coil springs.

As will be readily appreciated from the foregoing description, the invention provides an uncomplicated, shock absorber-type mechanism for supporting the cover of a spa or hot tub. The compressible struts provide a shock absorber-type support mechanism that eases both the removal and the closing of a hot tub cover. In addition to providing support while the cover is being opened or closed, the lift mechanism prevents the cover from being easily skewed or blown off by the wind.

BRIEF DESCRIPTION OF THE DRAWINGS

The foregoing objects and many of the attendant advantages of this invention will become more readily appreciated as the same becomes better understood by reference to the following detailed description when taken in conjunction with the accompanying drawings wherein.

DESCRIPTION OF THE PREFERRED EMBODIMENT

Figure 1A:
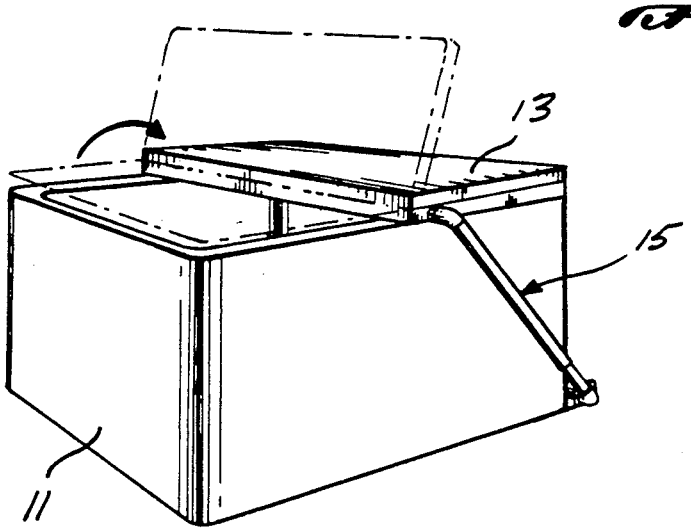
FIGS. 1A–C form a sequence of views illustrating the various positions of a spa cover and a spa cover lift mechanism formed in accordance with the invention as the cover is removed from a spa.
Figure 1B:
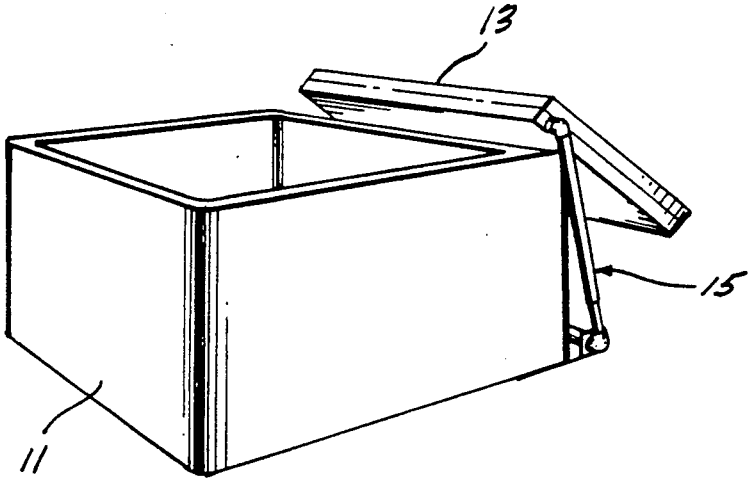
Figure 1C:
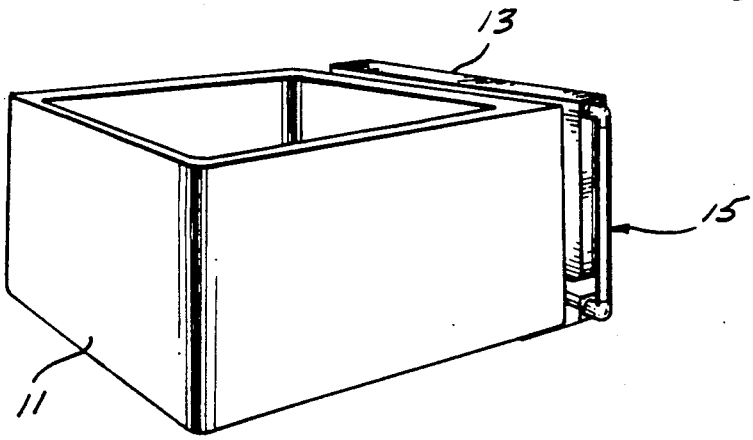

As best illustrated in FIGS. 1A–C, the present invention is directed to a lift mechanism 15 for assisting the removal and installation of the cover 13 of a spa or hot tub 11. While the spa or hot tub 11 illustrated in FIGS. 1A–C has the form of a rectangular parallelopiped, it is to be understood that the invention is also useful with spas and hot tubs having other configurations. Further, while the spa or hot tub cover 13 illustrated in FIGS. 1A–C is shown as hinged along its centerline and foldable, it is to be understood that a lift mechansim formed in accordance with this invention also can be utilized with unhinged spa or hot tub covers, or spa and hot tub covers that are hinged or folded in other manners.

Figure 2:
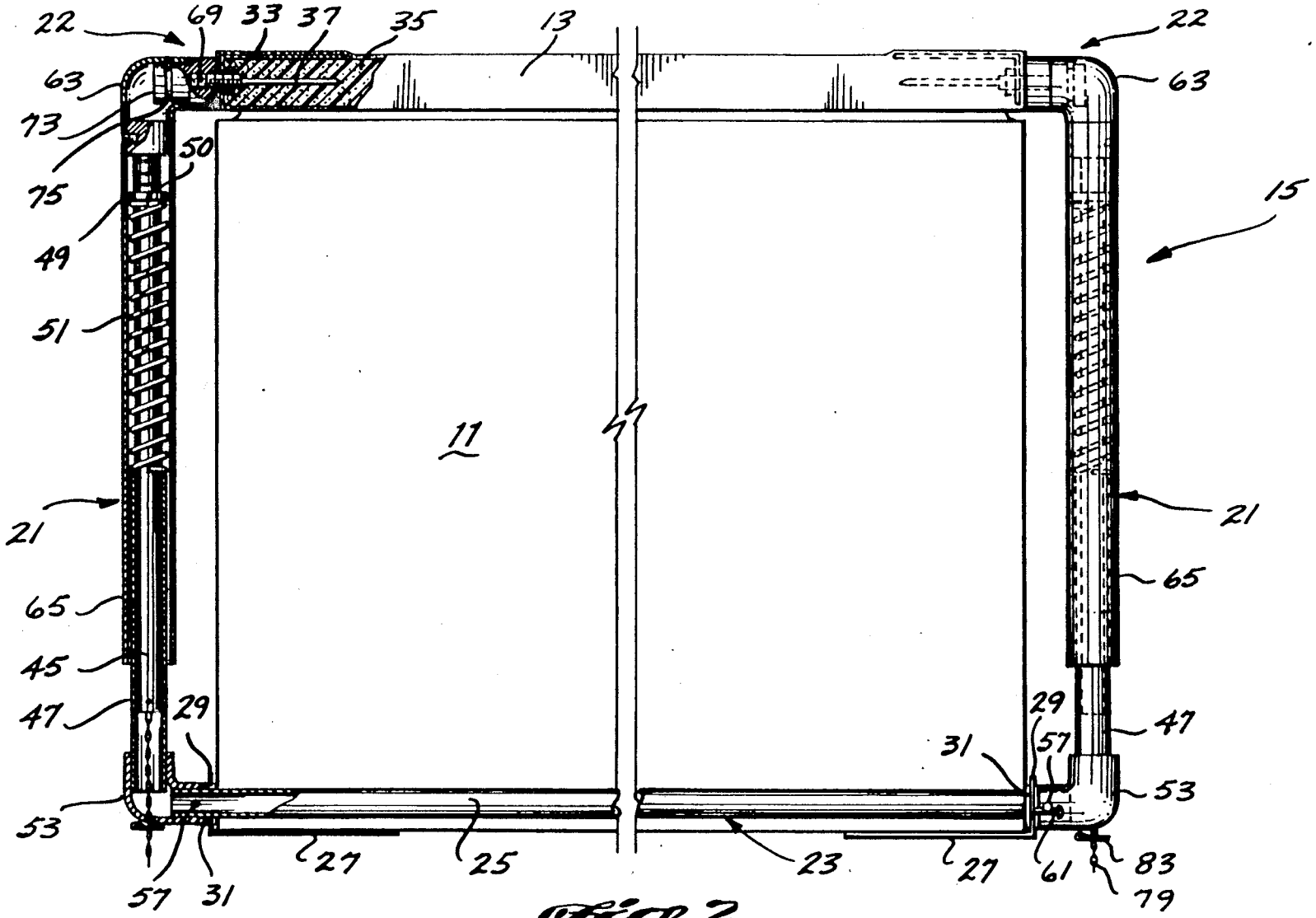
FIG. 2 is a front elevational view, partially in cross section, of the spa cover lift mechanism illustrated in FIGS. 1A–C.
Figure 3:
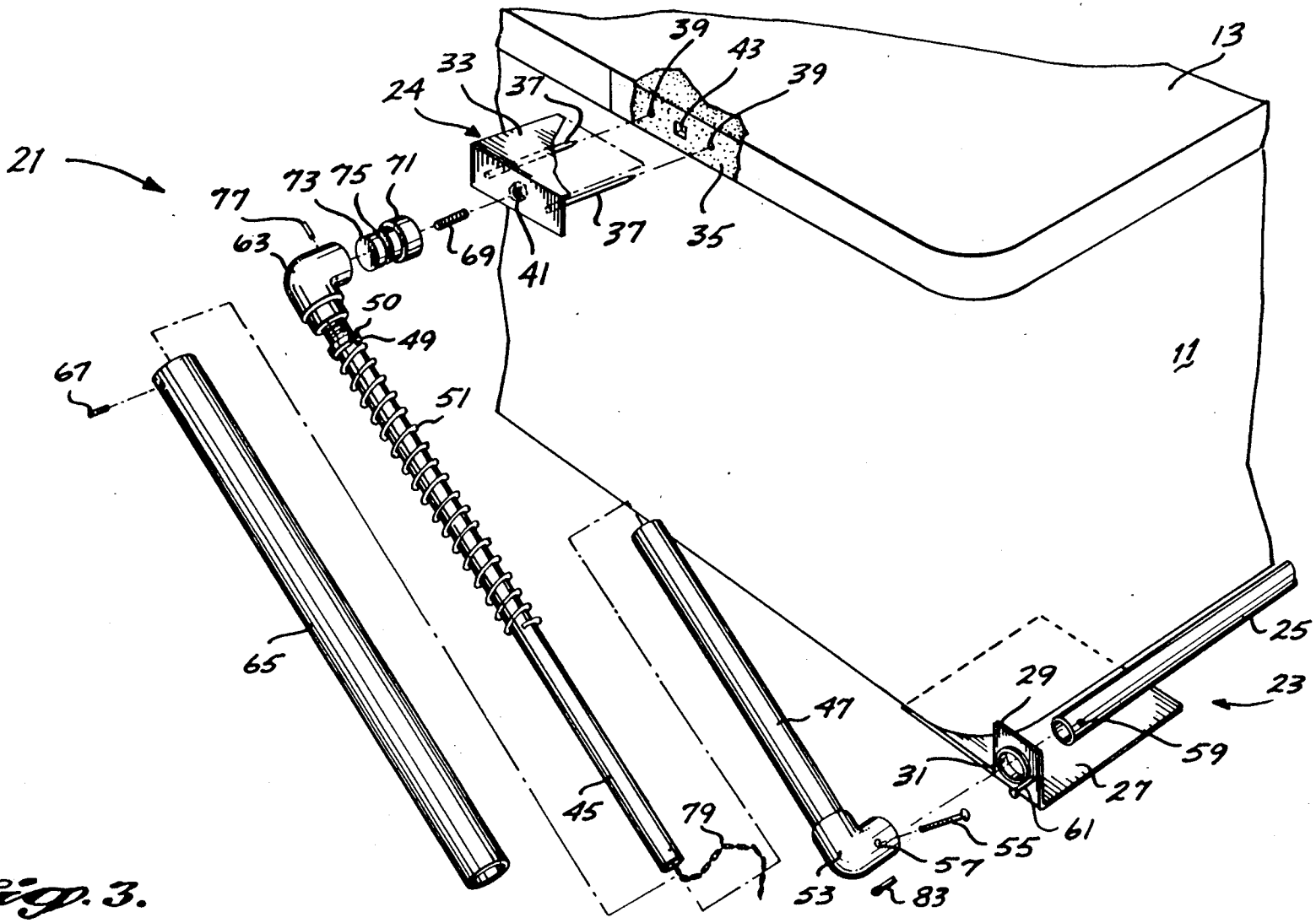
FIG. 3 is an exploded view of one side of the spa cover lift mechanism illustrated in FIG. 2.

As best shown in FIGS. 2 and 3, a spa or hot tub lift mechanism 15 formed in accordance with this invention comprises: a pair of compressible struts 21; an upper hinge mechanism 24; and a lower hinge mechanism 23. The struts 21 are located on opposite sides of the spa 11. The lower hinge mechanism 23 rotatably affixes the lower end of each of the struts 21 to points at or near the base of the spa, on opposite sides of the spa.

In the preferred embodiment of the invention illustrated in the figures, the lower hinge mechanism 23 includes a torque tube 25 located parallel to one of the lower base edges of the spa 11. Located at either end of the torque tube 25 is a plate 27 that extends under and is held down by the weight of the spa 11. Each plate 27 includes an upwardly extending flange 29. As best shown in FIG. 2, the plates 27 are positioned and the flanges 29 formed such that the flanges lie in parallel planes and are located slightly outwardly from the adjacent wall of the spa 11. Each of the flanges 29 includes a circular opening in which a bushing 31 is mounted. The torque tube 25 is mounted through the bushings 31, which are formed of a suitable low-friction material, such as nylon. Preferably, the torque tube is formed of a nonrusting metal, such as aluminum.

As best shown in FIG. 3, each of the upper hinge mechanisms 24 includes two L-shaped brackets 33. One of the legs of each of the L-shaped brackets 33 is larger than the other leg. The larger leg is positioned to lie atop the core 35 of the spa cover 13, which is formed of an insulating material, such as expanded polystyrene. The smaller leg of the L-shaped bracket 33 lies along the edge of the core 35. The L-shaped bracket 33 is affixed to the core 35 by a pair of prongs 37 that are affixed to the smaller leg and extend into suitable holes 39 punched into the core 35.

Affixed to the center of the smaller leg of the L-shaped bracket 33, i.e., the leg that lies along the edge of the core 35, on the inside thereof, is a nut 41. The nut lies in an aperture 43 cut in the core 35. The L-shaped bracket 33 is installed by positioning the bracket at a predetermined location along the edge of the core 35, such as two inches back from the hinged edge of the core, and pressing the prongs 37 into the core 35 so that the position of the nut-receiving hole 43 can be marked with a pen or other scribe; removing the bracket; and cutting the nut aperture 43. After the nut-receiving aperture is cut out, the L-shaped bracket is repositioned, and the prongs driven into the core 35. Because the larger leg of the L-shaped bracket 33 lies above the core 35, rather than beneath the core 35, the addition of the plate does not disrupt the fit between the bottom of the spa cover 13 and the upper edge of the spa 11. The larger leg of the L-shaped bracket 33, which is longer than the prongs 37, acts as a guide and prevents the prongs from protruding through the bottom of the core 35.

Each of the compressible struts 21 includes a pair of telescoping tubes 45 and 47. The outer (lower) tube 47 is larger in diameter and shorter than the inner (upper) tube 45. Mounted on the inner tube 45 remote from the end that extends into the outer tube 43 is a collar 49 that is held in place by a cotter pin 81 that extends through diametrically opposed holes located in the inner tube, above the collar. Mounted on the inner tube 45, between the collar 49 and the nearer edge of the outer tube 47, is a coil spring 51. Thus, the coil spring 51 is compressible between the collar 49 and the edge of the outer tube 47. Affixed to the other end of the outer tube 47 is one leg of an L-shaped lower elbow 53. The other leg of the lower elbow 53 is affixed to one end of the torque tube 25 by a bolt 55. The bolt 55 passes through aligned holes 57 and 59 in the leg of the elbow 53 and in the torque tube 25 and extends across the torque tube. In addition to fastening the torque tube 25 to the elbow 53, the bolt forms one-half of a stop. More specifically, the fastening bolt 55 extends outwardly a predetermined distance from the elbow. The distance is sized to allow the fastening bolt 55 to impinge on a stop bolt 61 attached to the outer surface of the flange 29 of the adjacent plate 27. The impingement of the fastening and stop bolts 55 and 61 limits the rotation of the compressible struts 21 in the manner hereinafter described.

One leg of an L-shaped upper elbow 63 is affixed to the other end of the inner tube 45. A tubular cover 65, sized to enclose the coil spring 51, is also affixed to the upper elbow 63, preferably by a cap screw 67.

The upper hinge mechanism 24 also includes a stud 69 threaded into the nut 41 affixed to the smaller leg of the L-shaped bracket 33. The stud is used to attach a pivot nut 71 to the L-shaped bracket 33. The pivot nut 71 includes a cylindrical hub 73 about which a groove 75 is circumferentially inscribed. The hub 73 is sized to fit into the other leg of the upper L-shaped elbow 63. A set screw 77 that passes through a hole in the elbow 63 and enters the groove 75 affixes the hub 73 to the elbow in a manner that allows the hub to rotate with respect to the elbow. That is, the co-action between the set screw 77 and the groove 75 prevents the hub from moving longitudinally, while allowing the hub of the pivot nut to rotate with respect to the elbow 63. As a result, both the upper and lower ends of the compression struts 21 are hinged, i.e., free to rotate with respect to the mechanisms that attach the ends to the plates 27 and the core 35. Sash chains 79 attached to the lower end of the inner tubes 45 of the struts 21 limit the extension of the inner tubes 45 with respect to the other tubes 47 that can be created by the coil spring 51. More specifically, each sash chain 79 extends through a hole (not shown) in the lower elbow 53. The length of sash chain 79 that can be pulled into the outer tube 47 by the force of the coil spring is controlled by the point where a hitch pin 83 is located in a link of the sash chain 79. Spring compression is controlled by positioning the collar 49 on the inner tube 45. More specifically, the collar 49 is movable between various positions along the length of the inner tube 45. When the collar 49 is at the desired position, the insertion of the cotter pin 81 through the nearest set of a number of pairs diametrically opposed holes formed in the inner tube 45 limits the upward movement of the collar.

In operation, starting from a closed position, the spa cover 13 is folded open, if the spa cover is a hinged cover of the type illustrated in FIGS. 1A–C. Thereafter, cover removal is accomplished by grasping the spa cover 13, preferably midway between the struts and pushing the cover outwardly, i.e., toward the side of the spa along which the torque tube is located. As the spa cover is pushed, it will pivot about the upper edge of the spa 11 that underlies the cover 13, as shown in FIG. 1B; and the compression struts 21 will rotate about both the upper and lower hinge mechanisms 24 and 23. When the compression struts 21 reach a vertical position (FIG. 1C), the plane of the spa cover 13 will have rotated to a vertical position substantially in line with the vertical struts. At this point, the bolts 55 and 61 will impinge on one another, stopping further rotation. When in this position, the compression struts 21 are in their most compressed position, i.e., the coil spring 51 is most compressed. Impingement of the cover 13 on the torque tube 25 is prevented by the force produced by the coil spring 51, which is controlled by the position of the collar 49. Excessive spring force, which would raise the cover well above the torque tube, is controlled by the same mechanism, i.e., the position of the collar 49.

The spa cover 13 is returned to its covering position by pulling the cover toward the center of the spa cover, resulting in a reversal of the sequence illustrated in FIGS. 1A-C.

As will be readily appreciated from the foregoing description, the invention provides a lift mechanism that assists the removal and installation of spa and hot tub covers. In addition to assisting in the removal and installation of spa and hot tub covers, the lift mechanism prevents the wind from skewing or removing a spa or hot tub cover after it has been installed in its covering position.

While a preferred embodiment of the invention has been illustrated and described, it will be appreciated that various changes can be made therein. For example, rather than mounting the plates of the lower hinge mechanism beneath the hot tub or pool so as to be held down by the weight of the spa or hot tub, the plates could be rotated by 90 degrees and attached to the outer surface of the spa or hot tub. In addition, for spa and hot tubs other than rectangularly shaped spas and hot tubs, such as octagonally shaped spas and hot tubs, the plates can be moved inwardly from the outboard position illustrated in FIGS. 1A-C. Further, other types of hinge mechanisms can be utilized, if desired. Consequently, within the scope of the appended claims, it is to be understood that the invention can be practiced otherwise than as specifically described herein.

The embodiments of the invention in which an exclusive property or privilege is claimed are defined as follows:

1. A lift mechanism for a spa or hot tub cover comprising:

(a) a pair of compressible struts;

(b) an upper hinge mechanism for attaching one end of each of said compressible struts to a spa or hot tub cover on opposite sides thereof; and (c) a lower hinge mechanism for affixing the other ends of said compressible struts to locations adjacent one edge of the base of a spa or hot tub, said lower hinge mechanism comprising:

(1) plate means for affixing said other ends of said compressible struts to a location adjacent one edge of the base of a spa or hot tub:

(2) a torque tube:

(3) rotation means for rotatably affixing said torque tube to said plate means; and (4) attachment means for attaching the other ends of said compressible struts to opposite ends of the torque tube.

2. A lift mechanism as claimed in claim 1, wherein each of said pair of compressible struts includes:

a pair of telescoping tubes; and compressible means for producing a force that causes tubes to telescope.

3. A lift mechanism as claimed in claim 2, wherein said compressible means includes a coil spring.

4. A lift mechanism as claimed in claim 1, wherein said upper hinge mechanism includes a pair of brackets and affixation means for affixing said brackets to opposite sides of a spa cover.

5. A lift mechanism as claimed in claim 4, wherein each of said pair of compressible struts includes:

a pair of telescoping tubes; and compressible means for producing a force that causes said tubes to telescope.

6. A lift mechanism as claimed in claim 5, wherein said compressible means includes a coil spring.

7. A lift mechanism as claimed in claim 4, wherein said brackets are L-shaped.

8. A lift mechanism as claimed in claim 7, wherein each of said pair of compressible struts includes:

a pair of telescoping tubes; and compressible means for producing a force that causes said tubes to telescope.

9. A lift mechanism as claimed in claim 8, wherein said compressible means includes a coil spring.

10. A lift mechanism as claimed in claim 1, wherein said plate means includes a pair of plates and wherein said rotation means includes vertically oriented flanges affixed to said means, apertures formed in said flanges and bushings mounted in said apertures, said torque tube mounted in said bushings.

* * * * *

UNITED STATES PATENT AND TRADEMARK OFFICE

CERTIFICATE OF CORRECTION

PATENT NO. : 5,048,153

DATED : September 17, 1991

INVENTOR(S) : M.R. Wall et al.

It is certified that error appears in the above-identified patent and that said Letters Patent is hereby corrected as shown below:

| COLUMN | LINE | ERROR |
|---|---|---|
| [57] | 14 | "fixed" should read --affixed--. |
| 1 | 38 | "protable" should read --portable--. |
| 6 | 13 | after "causes" insert --said--. |
| 6 | 40 | after "affixed to said" insert --plate--. |

Signed and Sealed this

Sixteenth Day of March, 1993

*Attest:*

STEPHEN G. KUNIN

*Attesting Officer*

*Acting Commissioner of Patents and Trademarks*